US008482510B2

(12) United States Patent
Chang et al.

(10) Patent No.: US 8,482,510 B2
(45) Date of Patent: Jul. 9, 2013

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(75) Inventors: Moon-Hwan Chang, Yongin-si (KR); Yong-Hoon Kwon, Asan-si (KR); Gi-Cherl Kim, Yongin-si (KR); Si-Joon Song, Suwon-si (KR); Sang-Il Park, Seoul (KR); Byoung-Dae Ye, Yongin-si (KR)

(73) Assignee: Samsung Display Co., Ltd. (KR)

( * ) Notice: Subject to any disclaimer, the term of this patent is extended or adjusted under 35 U.S.C. 154(b) by 530 days.

(21) Appl. No.: 12/617,769

(22) Filed: Nov. 13, 2009

(65) Prior Publication Data

US 2010/0123743 A1 May 20, 2010

(30) Foreign Application Priority Data

Nov. 14, 2008 (KR) ..... 10-2008-0113444

(51) Int. Cl.
*G09G 3/34* (2006.01)

(52) U.S. Cl.
USPC ..... 345/102

(58) Field of Classification Search
None
See application file for complete search history.

(56) References Cited

U.S. PATENT DOCUMENTS

| | | | | |
|---|---|---|---|---|
| 7,208,885 | B2 | 4/2007 | Hsu | |
| 7,295,180 | B2 * | 11/2007 | Ichikawa et al. | 345/102 |
| 7,352,352 | B2 * | 4/2008 | Oh et al. | 345/102 |
| 8,049,433 | B2 * | 11/2011 | Han | 315/282 |
| 2008/0309611 | A1 * | 12/2008 | Yang | 345/102 |

FOREIGN PATENT DOCUMENTS

| | | | |
|---|---|---|---|
| JP | 2002-056996 | A | 2/2002 |
| KR | 100816289 | B1 | 3/2008 |
| WO | WO 2008130138 | A1 * | 10/2008 |

* cited by examiner

*Primary Examiner* — Joseph Haley
(74) *Attorney, Agent, or Firm* — Cantor Colburn LLP

(57) ABSTRACT

A light source apparatus includes a light source module, a local dimming control part and a light source driving part. The light source module includes a plurality of light-emitting blocks. Each of the light-emitting blocks includes a first color light source, a second color light source and a third color light source, respectively. The local dimming control part drives the light-emitting blocks by blocks. The local dimming control part sets a reference duty signal for first, second and third color driving signals in accordance with a driving mode of the light source module. The light source driving part generates the first color driving signal, the second color driving signal and the third color driving signal by using the reference duty ratio set in accordance with the driving mode and a driving current having a same peak current level in accordance with the driving mode.

20 Claims, 9 Drawing Sheets

<SCANNING MODE>

<BOOSTING MODE>

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

This application claims priority to Korean Patent Application No. 2008-113444, filed on Nov. 14, 2008, and all the benefits accruing therefrom under 35 U.S.C. §119, the contents of which in its entirety are herein incorporated by reference.

BACKGROUND OF THE INVENTION

1. Field of the Invention

Exemplary embodiments of the present invention relate to a method of driving a light source, a light source apparatus for performing the method, and a display apparatus having the light source apparatus. More particularly, exemplary embodiments of the present invention relate to a method of driving a light source capable of improving display quality, a light source apparatus for performing the method, and a display apparatus having the light source apparatus.

2. Description of the Related Art

Generally, a liquid crystal display ("LCD") apparatus includes an LCD panel that displays images using a light-transmitting ratio of liquid crystal molecules, and a backlight assembly disposed below the LCD panel to provide the LCD panel with light.

The LCD panel includes an array substrate, a color filter substrate and a liquid crystal layer interposed between the array substrate and the color filter. The array substrate includes a plurality of pixel electrodes and a plurality of thin-film transistors ("TFTs") connected to the pixel electrode. The color filter substrate includes a common electrode and a plurality of color filters. When an electric field is applied to the liquid crystal layer, an arrangement of liquid crystal molecules of the liquid crystal layer is altered to change optical transmissivity so that an image is displayed. Here, when the optical transmissivity of the light is increased to a maximum, the LCD panel realizes a white image such that luminance is high. However, when the optical transmissivity of the light is decreased to a minimum, the LCD panel realizes a black image such that luminance is low.

Recently, a method of local dimming of a light source has been developed, which controls an amount of light of the light-emitting blocks in accordance with luminance of an image corresponding to the light-emitting blocks. Also, various local dimming modes have been developed in accordance with an image disposed on an LCD panel based on the local dimming method. For example, the various local dimming methods may include a conventional local dimming mode which is driven by a driving block in accordance with a gradation of the image, a scanning dimming mode which is sequentially driven by a predetermined number of driving blocks in accordance with a moving image, a boosting mode which is driven by boosting a luminance of a bright image, etc.

BRIEF SUMMARY OF THE INVENTION

It has been determined herein that in a conventional light source apparatus and method of driving the light source apparatus, peak current levels of driving signals may be different from each other, which are provided to a driving block in accordance with various modes of the local dimming method. For example, a peak current level of the driving signal may be increased in a sequence of the conventional local dimming mode, the scanning mode and the boosting mode. Thus, as the peak current levels are different from each other, luminance and color coordinate characteristics may be varied. Therefore, display quality may differ in accordance with the driving mode in varying degrees in the conventional light source apparatus and method of driving the same.

Exemplary embodiments of the present invention provide a method of driving a light source capable of improving display quality.

Exemplary embodiments of the present invention further provide a light source apparatus for performing the above-mentioned method.

Exemplary embodiments of the present invention still further provide a display apparatus having the above-mentioned light source apparatus.

According to an exemplary embodiment of the present invention, there is provided a method of driving a light source including a plurality of light-emitting blocks by blocks, each of the light-emitting blocks including a first color light source, a second color light source and a third color light source. In the method, reference duty ratios for driving signals of first, second and third colors are differently set in accordance with a driving mode of a light source module. Then, a driving signal of a substantially equal peak current level is applied to the light source module in accordance with the driving mode. Then, the first, second and third color light sources are driven by using a driving current having a reference duty ratio set in accordance with the driving mode and the equal peak current level in accordance with the driving mode.

According to another exemplary embodiment of the present invention, a light source apparatus includes a light source module, a local dimming control part and a light source driving part. The light source module includes a plurality of light-emitting blocks. Each of the light-emitting blocks includes a first color light source, a second color light source and a third color light source, respectively. The local dimming control part drives the light-emitting blocks by blocks. The local dimming control part sets a reference duty signal for first, second and third color driving signals in accordance with a driving mode of the light source module. The light source driving part generates the first color driving signal, the second color driving signal and the third color driving signal by using a reference duty ratio set in accordance with the driving mode and a driving current having a same peak current level in accordance with the driving mode.

According to still another exemplary embodiment of the present invention, a display apparatus includes a display panel, a light source module, a local dimming control part and a light source driving part. The display panel includes gate lines and data lines that are crossed with each other to display an image. The light source module includes a plurality of light-emitting blocks. Each of the light-emitting blocks includes a first color light source, a second color light source and a third color light source, respectively. The local dimming control part drives the light-emitting blocks by blocks. The local dimming control part sets a reference duty signal for first, second and third color driving signals in accordance with a driving mode of the light source module. The light source driving part generates the first color driving signal, the second color driving signal and the third color driving signal by using the reference duty ratio set in accordance with the driving mode and a driving current having a same peak current level in accordance with the driving mode.

According to some exemplary embodiments of the present invention, a peak current level of a driving signal is set to be the maximum level and a duty ratio of the driving signal is controlled in accordance with the driving mode, so that luminance and color coordinates according to the driving mode may be prevented from being varied.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION OF THE INVENTION

Figure 1:
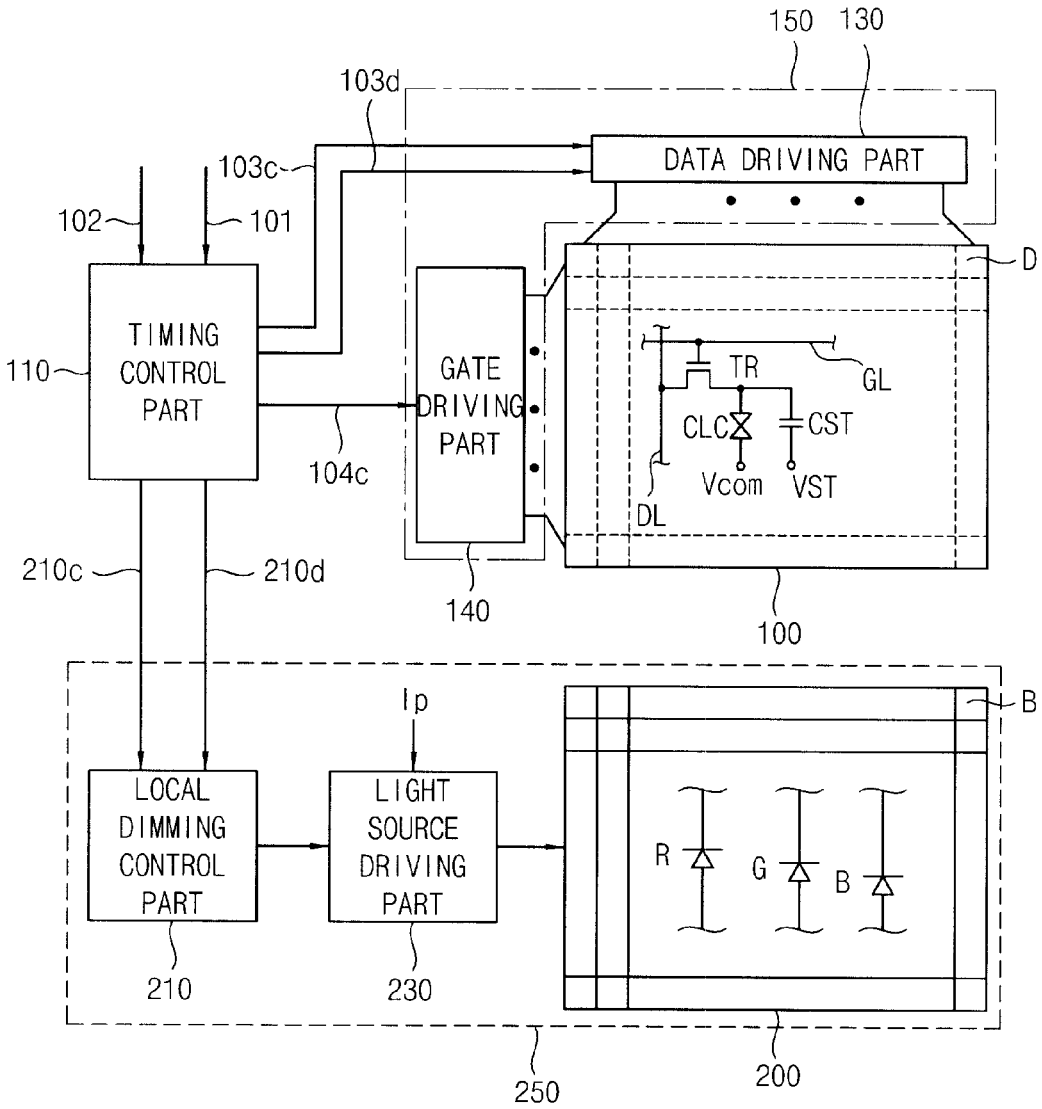
FIG. 1 is a block diagram of an exemplary display apparatus according to an exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to schematic illustrations of idealized example embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

FIG. 1 is a block diagram of an exemplary display apparatus according to an exemplary embodiment of the present invention.

Referring to FIG. 1, the display apparatus includes a display panel 100, a timing control part 110, a panel driving part 150 and a light source apparatus 250.

The display panel 100 includes a plurality of pixels P displaying an image. For example, the number of pixels may be M×N ('M' and 'N' are natural numbers). In an exemplary embodiment, the pixels P may be arranged in a matrix configuration. Each of the pixels P includes a switching element TR connected to a gate line GL and a data line DL, a liquid crystal capacitor CLC connected to the switching element TR and a storage capacitor CST connected to the switching element TR.

The timing control part 110 receives a control signal 101 and an image signal 102 from an external device (not shown). The timing control part 110 generates a timing control signal controlling a driving timing of the display panel 100 by using the received control signal 101. The timing control signal includes a clock signal, a horizontal start signal and a vertical start signal.

The panel driving part 150 includes a data driving part 130 and a gate driving part 140.

The data driving part 130 drives the data line DL by using a data control signal 103*c* and an image signal 103*d* that are provided from the timing control part 110. That is, the data driving part 130 converts the image signal 103*d* into a data signal of an analog type, and outputs the data signal to the data line DL. The gate driving part 140 drives the gate line GL by using a gate control signal 104*c* that is provided from the timing control part 110. That is, the gate driving part 140 outputs a gate signal to the gate line GL.

The light source apparatus 250 includes a light source module 200, a local dimming control part 210 and a light source driving part 230.

The light source module 200 includes a printed circuit board ("PCB") having a plurality of light sources mounted thereon. The light source module 200 includes a first color light source, a second color light source and a third color light source. Hereinafter, as an exemplary embodiment, it will be described that the first color, second and third colors are a red color, a green color and a blue color, respectively. The light source module 200 is divided into I×J (where 'I' and 'J' are natural numbers) light-emitting blocks B. The light-emitting blocks B emit lights with a luminance corresponding to a gradation of an image displayed on the display panel 100 corresponding to the light-emitting blocks B. That is, the light source module 200 is driven in a local dimming method. Each of the light-emitting blocks B includes a plurality of light sources. The light source may be a light-emitting diode ("LED").

The light source module 200 may be driven by a plurality of local dimming modes, for example, a normal local dimming mode which individually drives the light-emitting blocks in accordance with a luminance of each of a plurality of corresponding image blocks (referred to as a normal mode), a scanning local dimming mode which drives the light-emitting blocks in a direction of gate lines in a display panel (referred to as a scanning mode), a boosting local dimming mode which drives a predetermined light-emitting block of the light-emitting blocks in a maximum luminance (referred to as a boosting mode), etc.

The local dimming control part 210 judges a local dimming driving mode (referred to as a driving mode) of the light source module 200, and determines a reference duty ratio corresponding to the driving mode. The local dimming control part 210 determines duty ratios of red color, green color and blue color driving signals for controlling a color luminance by the light-emitting blocks B based on the determined reference duty ratio.

The light source driving part 230 generates red color, green color and blue color driving signals for driving the light-emitting blocks B. Here, the light source driving part 230 generates driving signals having the same peak current level Ip with respect to the driving modes. For example, the peak level Ip of the driving signal corresponds to the maximum peak current level of the driving signals which drive the driving modes. Therefore, the peak current levels of the driving current Ip of the red color, green color and blue color driving signals PWM_R, PWM_G, and PWM_B are substantially equal to each other in the driving modes.

Figure 2:
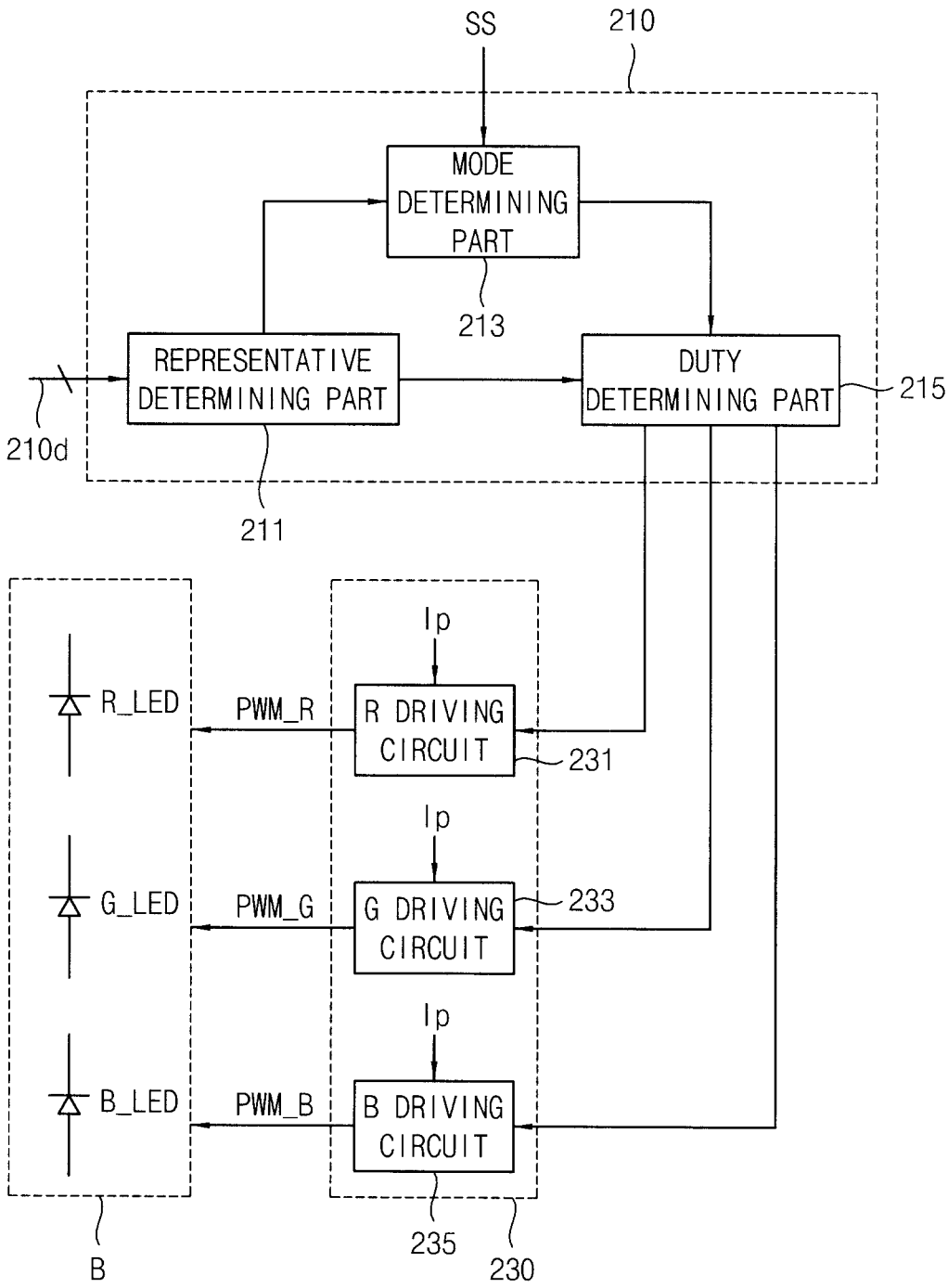
FIG. 2 is a detailed diagram of an exemplary light source apparatus of FIG. 1.

FIG. 2 is a detailed diagram of an exemplary light source apparatus of FIG. 1.

Referring to FIGS. 1 and 2, the light source apparatus 250 includes the local dimming control part 210, a light source driving part 230 and a light source module 200.

The local dimming control part 210 includes a representative determining part 211, a mode determining part 213 and a duty determining part 215. The local dimming control part 210 receives a control signal 210*c* and an image signal 210*d* from the timing control part 110. The representative determining part 211 divides the image signal 210*d* provided from the timing control part 110 into a plurality of image blocks D corresponding to the light-emitting blocks B. The representative determining part 211 determines red, green and blue color representative data by using red, green and blue color data of each image block D. A representative gradation of the red, green and blue color representative data may be the maximum gradation of the data of the image block D or an average data of the data of the image block D. Thus, the representative determining part 211 determines red, green and blue color representative data of the image blocks D corresponding to the light-emitting blocks B.

The mode determining part 213 judges a driving mode of the light-emitting module 200 by using the representative data corresponding to the image blocks D. For one example, when a deviation between the representative data of the image blocks D is uniform, the mode determining part 213 judges the driving mode as a normal mode. For another example, when the maximum representative data is condensed at a predetermining portion, the mode determining part 213 judges the driving mode as a boosting mode. Moreover, as the scanning mode is a mode that will be selected by a user, the mode determining part 213 may judge the scanning mode in accordance with a scanning selection mode SS provided from an external device (not shown).

The mode determining part 213 determines a reference duty ratio of the driving mode, for example, a white duty ratio in accordance with the judged driving mode. Conventionally, a red color light, a green color light and a blue color light are mixed, so that a white light is displayed. Thus, the red, green and blue color driving signals PWM_R, PWM_G, and PWM_B, which respectively drive the red, green and blue color light sources R_LED, G_LED, and B_LED, have a duty ratio (A:B:C) for increasing and decreasing a luminance according to the peak current level of driving current Ip that is set and maintaining a white color coordinate. Accordingly, the mode determining part 213 linearly increases or decreases the duty ratio (A:B:C) in accordance with the driving mode to determine a reference duty ratio with respect to the red, green and blue color driving signals PWM_R, PWM_G, and PWM_B. For example, the mode determining part 213 determines the reference duty ratio as a first duty ratio (nA:nB:nC) in the normal mode, and determines the reference duty ratio as a second duty ratio (mA:mB:mC) in the scanning mode. Also, the mode determining part 213 determines the reference duty ratio as a third duty ratio (kA:kB:kC) in the boosting mode. The reference duty ratio may be a duty ratio for displaying white in each of the driving modes. Here, B>C>A, 'n,' 'm' and 'k' are actual numbers, and k>m>n.

The duty determining part 215 determines duty ratios of red, green and blue color driving signals PWM_R, PWM_G, and PWM_B by using the red, green and blue color representative data corresponding to the light-emitting blocks B based on the reference duty ratio. Thus, the red, green and blue color driving signals PWM_R, PWM_G, and PWM_B may have a duty corresponding to the driving mode.

The light source driving part 230 includes a red driving circuit 231, a green driving circuit 233 and a blue driving circuit 235, and generates the red, green and blue color driving signals PWM_R, PWM_G, and PWM_B by using the driving current Ip corresponding to the set peak current level and the duty ratios determined at the duty determining part 215. The red driving circuit 231 outputs the red driving signal PWM_R to a red color light source R_LED included in the light-emitting block B, the green driving circuit 233 outputs the green driving signal PWM_G to a green color light source G_LED included in the light-emitting block B, and the blue driving circuit 235 outputs the blue driving signal 235 PWM_B to a blue color light source B_LED included in the light-emitting block B.

As the light source module 200 includes red, green and blue color light sources R_LED, G_LED, and B_LED, the light source module 200 may perform a white local dimming when the light source module 200 provides the display panel 100 with a white light, and may perform a color local dimming when the light source module 200 provides the display panel 100 with a color light.

Figure 3:
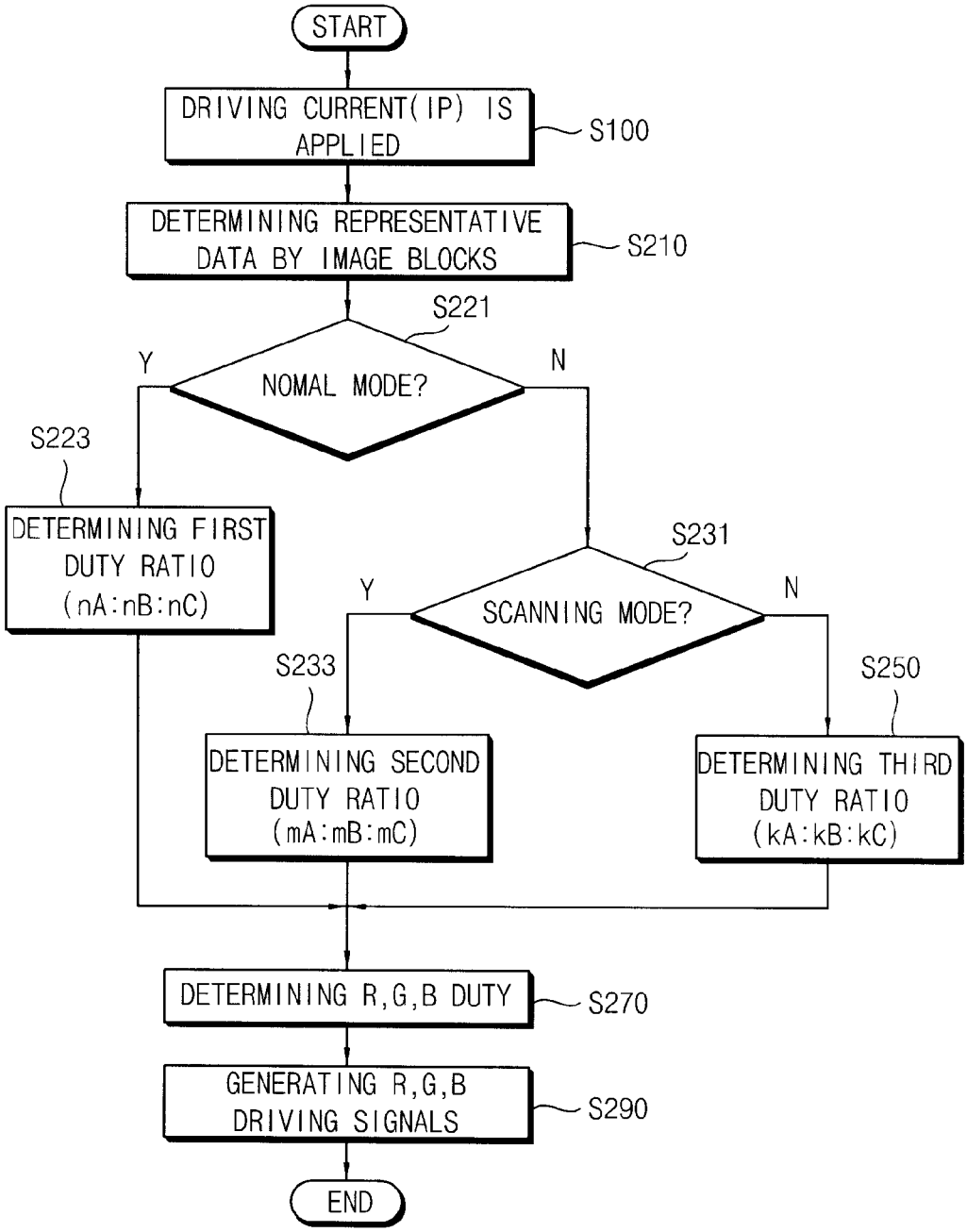
FIG. 3 is a flowchart diagram illustrating an exemplary driving method of an exemplary light source apparatus of FIG. 2.

FIG. 3 is a flowchart diagram illustrating an exemplary driving method of an exemplary light source apparatus of FIG. 2.

Referring to FIGS. 2 and 3, a driving current Ip that is set to generate the driving signals PWM_R, PWM_G, and PWM_B is applied to the light source driving part 230 (step S100). The driving current Ip has a peak current level of a driving current corresponding to a driving mode having the maximum luminance among driving modes of the light source apparatus 250.

The representative determining part 211 determines red, green and blue color representative data of the image blocks D by using the image signal 210*d*, that is, a red color data, a green color data and a blue color data (step S210). The mode determining part 213 determines a driving mode of the light source apparatus 250 based on the representative data of the image blocks D and a selection signal SS for a driving mode provided from an external device (not shown).

For example, when a driving mode of the light source apparatus 250 is a normal mode (as determined within step S221), the mode determining part 213 determines a reference duty ratio as a first duty ratio (nA:nB:nC) set in accordance with the normal mode (step S223). If the driving mode of the light source apparatus 250 is not a normal mode, then it is determined if a driving mode of the light source apparatus 250 is a scanning mode (step S231), and when the driving mode of the light source apparatus 250 is a scanning mode, the mode determining part 213 determines a reference duty ratio as a second duty ratio (mA:mB:mC) set in accordance with the scanning mode (step S233). If the driving mode of the light source apparatus 250 is not a normal mode and not a scanning mode, then a driving mode of the light source apparatus 250 is a boosting mode, and the mode determining part 213 determines a reference duty ratio as a third duty ratio (kA:kB:kC) set in accordance with the boosting mode (step S250).

The duty determining part 215 determines red, green and blue color data by using the reference duty ratio set by the driving modes and the red, green and blue representative data of the light-emitting blocks B (S270).

The light source driving part 230 generates the red, green and blue color driving signals PWM_R, PWM_G, and PWM_B by using the driving current Ip and the red, green and blue color duty data (step S290). As a result, the light source module 200 performs a local dimming by the red, green and blue color driving signals PWM_R, PWM_G, and PWM_B to which a reference ratio according to a driving mode is employed.

Figure 4:
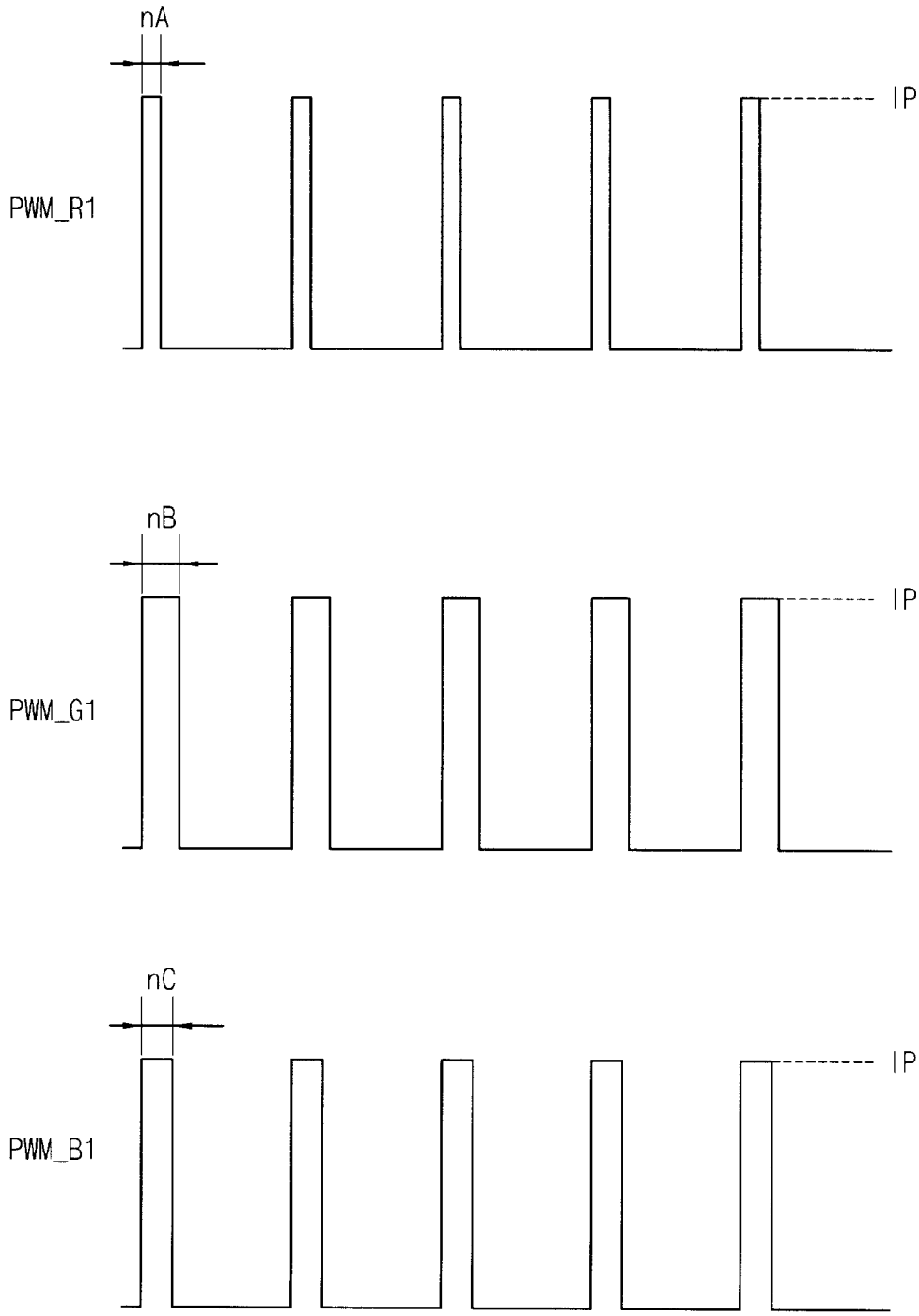
FIG. 4 shows waveform diagrams of red, green and blue color driving signals of a normal mode.

FIG. 4 shows waveform diagrams of exemplary red, green and blue color driving signals of a normal mode.

Referring to FIG. 4, the first driving signals PWM_R1, PWM_G1, PWM_B1 of red, green and blue colors, respectively, for a white in the normal mode have the same peak current level of the driving current Ip. The first driving signals PWM_R1, PWM_G1, PWM_B1 of red, green and blue colors, respectively, have the first duty ratio (nA:nB:nC).

Figure 5:
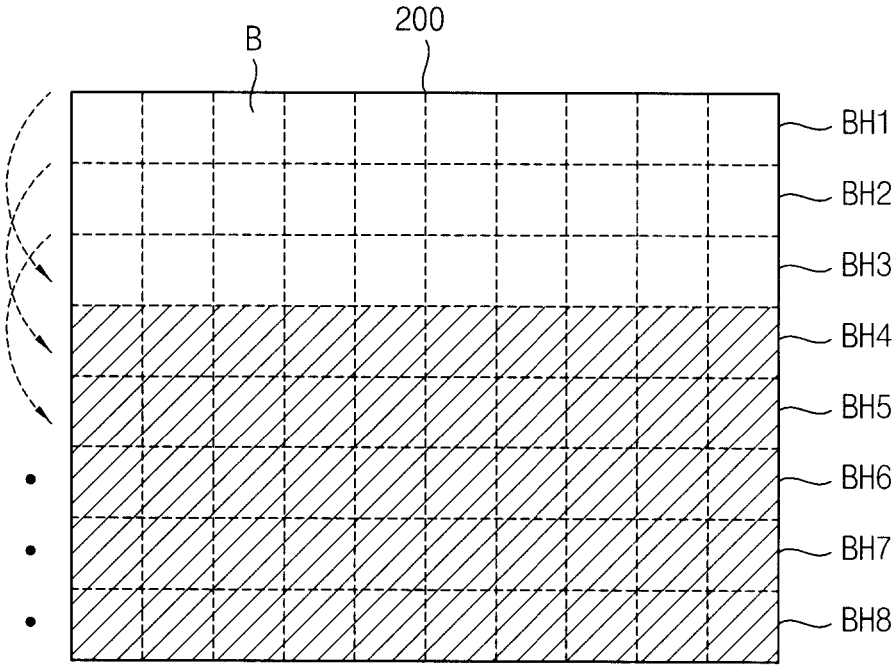
FIG. 5 is a driving schematic diagram of an exemplary light source module in a scanning mode.
Figure 6:
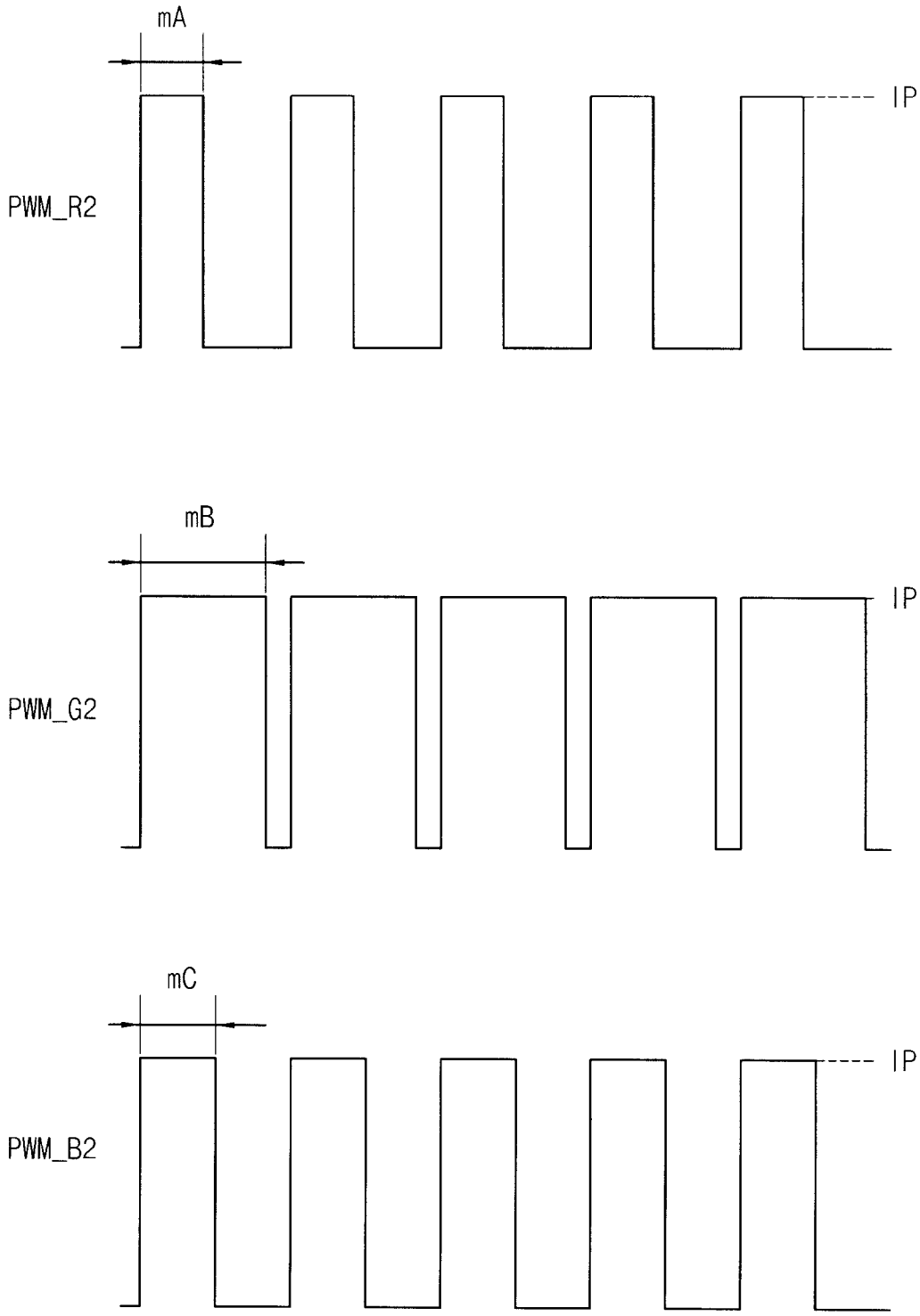
FIG. 6 shows waveform diagrams of red, green and blue color driving signals of a scanning mode.

FIG. 5 is a driving schematic diagram of an exemplary light source module in a scanning mode. FIG. 6 shows waveform diagrams of red, green and blue color driving signals of a scanning mode.

Referring to FIGS. 5 and 6, the light source module 200 includes a plurality of light-emitting rows BH1, BH2, . . . , BH8 which include a plurality of light-emitting blocks B, respectively. The light-emitting rows BH1, BH2, . . . , BH8 are in parallel with gate lines of a display panel 100, such as shown in FIG. 1. The light-emitting rows BH1, BH2, . . . , BH8 may be sequentially driven in a display direction of an image.

The scanning mode is a driving mode for enhancing a response time of a moving image when a moving image is displayed on the display panel 100. The scanning mode may be set by a mode selection of a user. Thus, in the scanning mode, the light-emitting rows BH1, BH2, . . . , BH8 of the light source module 200 may be sequentially driven in a uniform rule. For example, the total eight light-emitting rows BH1, BH2, . . . , BH8 may sequentially emit lights by three light-emitting rows for one frame. That is, the three light-emitting rows may emit lights in a sequence such as (BH1, BH2 and BH3), (BH2, BH3 and BH4), (BH3, BH4 and BH5), etc., for one frame.

In the scanning mode, second driving signals PWM_R2, PWM_G2 and PWM_B2 of red, green and blue colors, respectively, for white have substantially the same peak current level for the driving current Ip. Alternatively, second driving signals PWM_R2, PWM_G2 and PWM_B2 of the red, green and blue colors have the second duty ratio (mA:mB:mC). Here, 'm' is greater than 'n' of the first duty ratio (nA:nB:nC), and the first driving signals PWM_R1, PWM_G1 and PWM_B1 and the second driving signals PWM_R2, PWM_G2 and PWM_B2 have the same peak current level for the driving current Ip.

Figure 7:
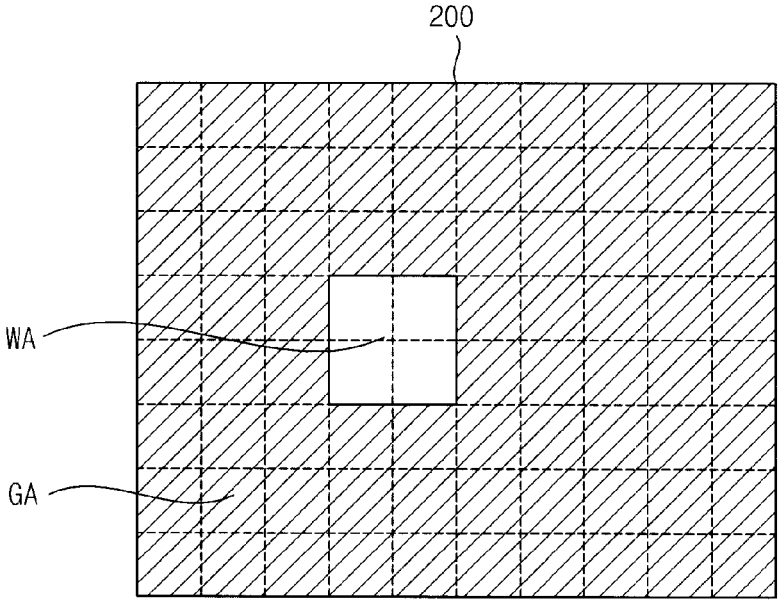
FIG. 7 is a driving schematic diagram of an exemplary light source module in a boosting mode.
Figure 8:
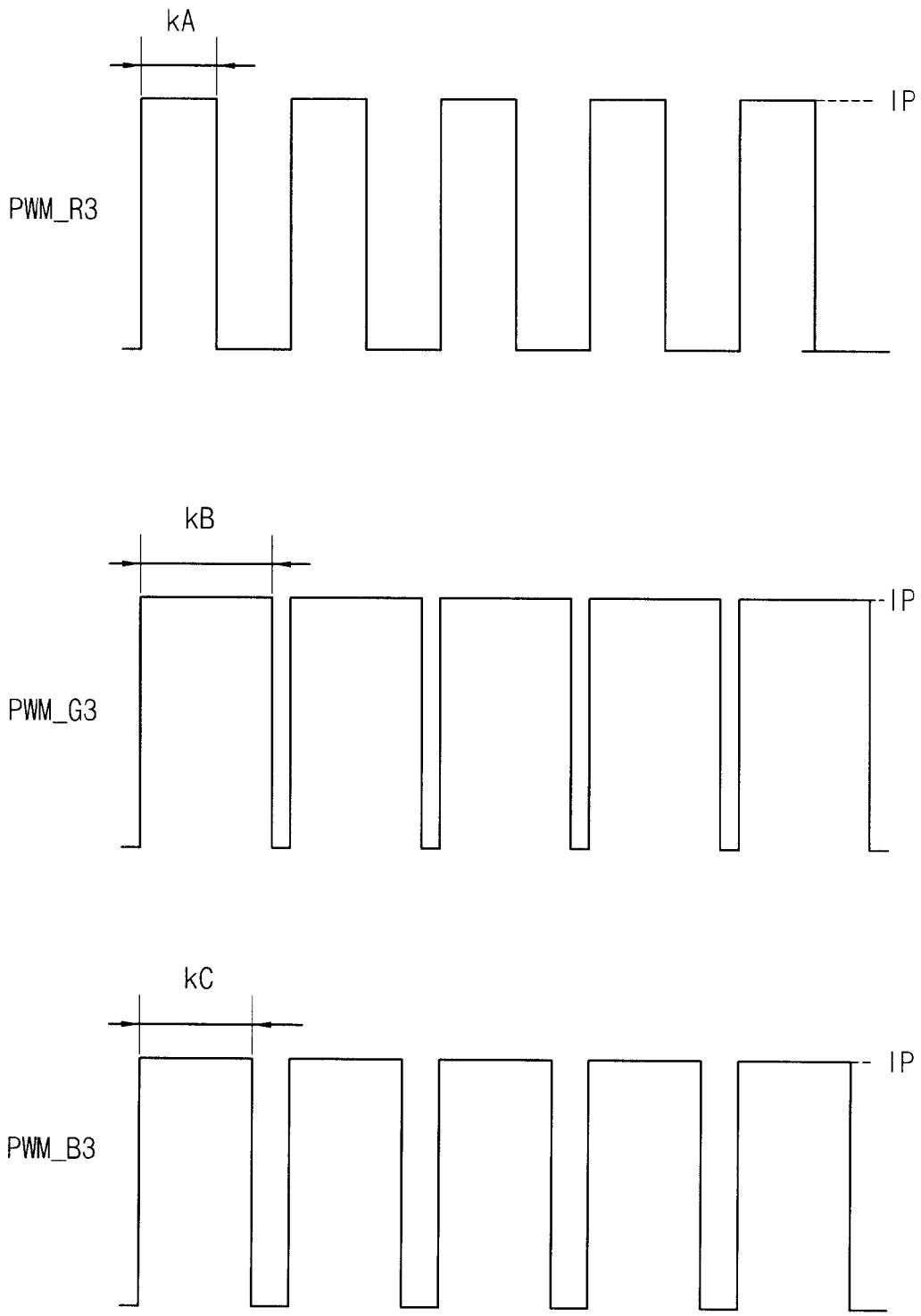
FIG. 8 shows waveforms of red, green and blue color driving signals of a boosting mode.

FIG. 7 is a driving schematic diagram of an exemplary light source module in a boosting mode. FIG. 8 shows waveforms of red, green and blue color driving signals of a boosting mode.

Referring to FIGS. 7 and 8, the light source module 200 includes a first area WA having a high luminance in accordance with a high gradation and a second area GA having a low luminance in accordance with a low gradation. In the present embodiment, the boosting mode is a mode which boosts luminance of the first area WA rather than the second area GA. That is, the boosting mode is a driving mode enhancing a contrast ratio.

In the boosting mode, the third driving signals PWM_R3, PWM_G3 and PWM_B3 of red, green and blue colors, respectively, for white have substantially the same peak current level for driving current Ip. Alternatively, third driving signals PWM_R3, PWM_G3 and PWM_B3 of the red, green and blue colors have the third duty ratio (kA:kB:kC). Here, 'k' is greater than 'm' of the second duty ratio (mA:mB:mC). Also, the third driving signals PWM_R3, PWM_G3 and PWM_B3, the first driving signals PWM_R1, PWM_G1 and PWM_B1, and the second driving signals PWM_R2, PWM_G2 and PWM_B2 have the same peak current level for the driving current Ip.

In a case of the boosting mode, the first area WA, which is driven in a maximum luminance capable of driving the light source module 200, is driven so that a duty ratio of the green driving signal PWM_G3 of which a pulse width is greatest in the third duty ratio (kA:kB:kC) may be set as about 100%.

In the exemplary embodiment, it has been described that a driving mode of the light source apparatus includes a normal mode, a scanning mode and a boosting mode. Alternatively, the driving mode may include various modes. When the light source apparatus includes the various modes, a peak current level of the driving signals may be set to be substantially equal to a peak level of the maximum driving current among the various modes, and duty ratios may be differently set by the various modes.

Figure 9:
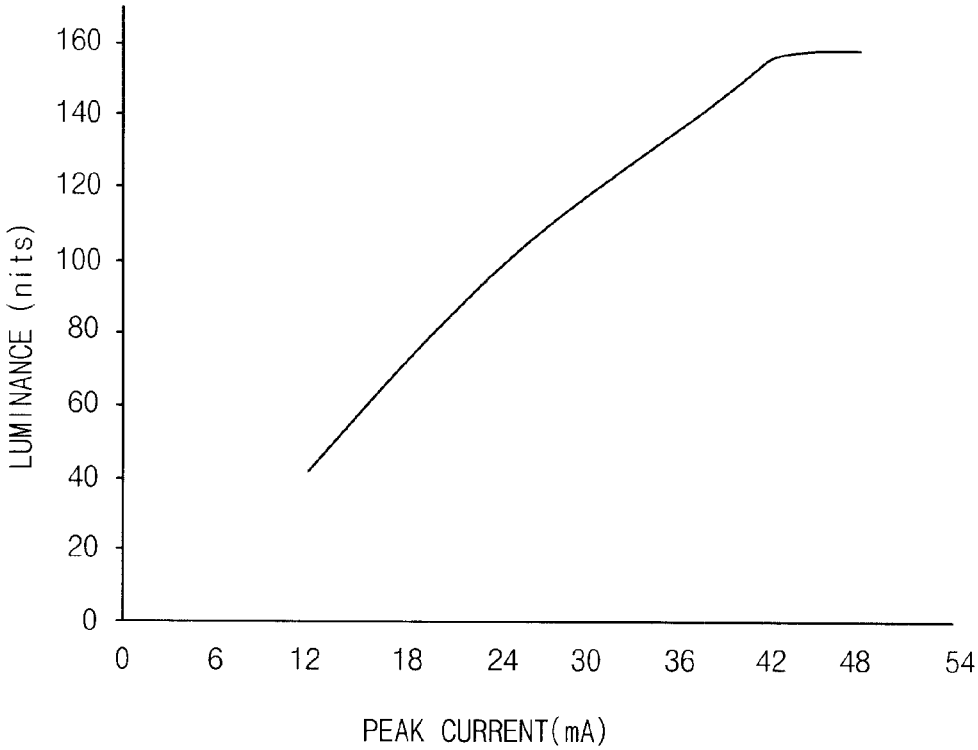
FIG. 9 is a graph illustrating a relationship between a peak current level and a luminance of a driving signal in accordance with a comparative example.
Figure 10:
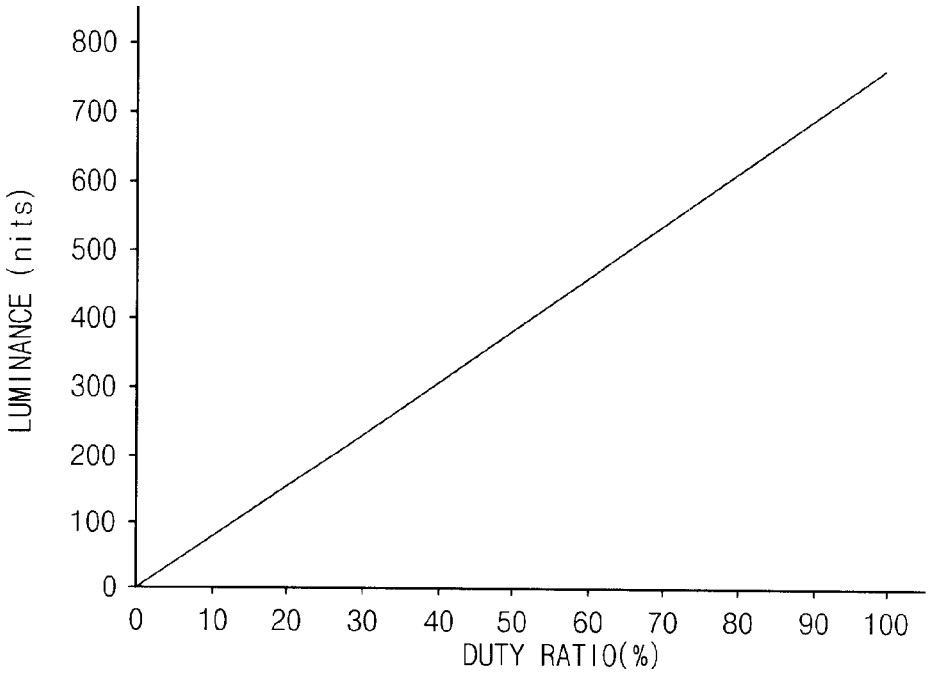
FIG. 10 is a graph illustrating a relationship between a duty ratio and luminance of a driving signal in accordance with an exemplary embodiment of the invention.

FIG. 9 is a graph illustrating a relationship between a peak current level and a luminance of a driving signal in accordance with a comparative example. FIG. 10 is a graph illustrating a relationship between a duty ratio and luminance of a driving signal in accordance with an exemplary embodiment of the invention.

Referring to FIG. 9, as a peak current level of the driving signal was increased, a luminance was also increased. However, a luminance variation at more than about 40 mA was not detected. That is, at a peak current level of more than about 40 mA, luminance did not correspondingly increase. Moreover, a substantially perfect linearity was not detected in an interval where a luminance is linearly increased. Thus, when the peak current level is varied to display a gradation of an image on a display panel, it is estimated that a gradation of an image is not easy to control.

Referring to FIG. 10, as a peak current level of the driving signal was increased, a luminance was also increased. A luminance variation according to the duty ratio has a substantially perfect linearity. Thus, when the peak current level is varied to display a gradation of an image on a display panel, it is estimated that a gradation of an image is easy to control.

Comparing the comparative embodiment with the exemplary embodiment, it is determined that display quality is increased when an image is displayed by controlling a duty ratio of the driving signal rather than by controlling a peak current level of the driving signal.

According to exemplary embodiments of the present invention, a peak current level of a driving signal which drives a light source module is set to be the maximum level and a duty ratio of the driving signal is controlled in accordance with a driving mode, so that luminance and color coordinates according to the driving mode may be prevented from being varied. Therefore, display quality of an image that is displayed on a display apparatus may be enhanced.

The foregoing is illustrative of the present invention and is not to be construed as limiting thereof Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a light source comprising a plurality of light-emitting blocks, each of the light-emitting blocks comprising a first color light source, a second color light source and a third color light source, the method comprising:

differently setting reference duty ratios for driving signals of first, second and third colors in accordance with a plurality of local dimming driving modes of a light source module, the local dimming driving mode being determined using representative image data corresponding to each of a plurality of image blocks, which correspond to the plurality of light-emitting blocks, respectively;

applying a driving signal of a substantially equal peak current level to the light source module in accordance with the driving mode; and driving the first, second and third color light sources by using a driving current having a reference duty ratio set in accordance with the driving mode and the equal peak current level in accordance with the driving mode, wherein the peak current levels of the local dimming driving modes are the same as each other, and the reference duty ratios of the local dimming driving modes are different from each other.

2. The method of claim 1, further comprising determining the driving mode by using an image signal received from an external device or a selection signal corresponding to the driving mode.

3. The method of claim 1, wherein the reference duty ratio is a duty ratio of driving signals for the first, second and third color light sources to display white.

4. The method of claim 1, wherein the peak current level is substantially equal to a maximum peak current level of a plurality of peak current levels that is employed to various driving modes of the light source module.

5. The method of claim 4, wherein the reference duty ratio has a linear characteristic with respect to the various driving modes of the light source module.

6. The method of claim 5, wherein a reference duty ratio of the first, second and third colors is nA:nB:nC in a normal mode (B>C>A, and 'n' is an actual number), a reference duty ratio of the first, second and third colors is mA:mB:mC in a scanning mode ('m' is an actual number), and a reference duty ratio of the first, second and third colors is kA:kB:kC in a boosting mode ('k' is an actual number, and k>m>n).

7. The method of claim 1, wherein the driving mode of the light source module comprises at least one of a normal mode which individually drives the light-emitting blocks in accordance with a luminance of each of a plurality of corresponding image blocks, a scanning mode which drives the light-emitting blocks in a direction of gate lines in a display panel, and a boosting mode which drives a predetermined light-emitting block of the light-emitting blocks in a maximum luminance.

8. A light source apparatus comprising:

a light source module comprising a plurality of light-emitting blocks, each of the light-emitting blocks comprising a first color light source, a second color light source and a third color light source, respectively;

a local dimming control part which independently drives each of the light-emitting blocks, the local dimming control part sets a reference duty signal for first, second and third color driving signals in accordance with a plurality of local dimming driving modes of the light source module, the local dimming driving mode being determined using representative image data corresponding to each of a plurality of image blocks, which correspond to the plurality of light-emitting blocks, respectively; and a light source driving part which generates the first color driving signal, the second color driving signal and the third color driving signal by using a reference duty ratio set in accordance with the driving mode and a driving current having a same peak current level in accordance with the driving mode, wherein the peak current levels of the local dimming driving modes are the same as each other, and the reference duty ratios of the local dimming driving modes are different from each other.

9. The light source apparatus of claim 8, wherein the local dimming control part comprises:

a representative determining part which divides an image signal into a plurality of image blocks corresponding to the light-emitting blocks, the representative determining part determining a first color representative data, a second color representative data and a third color representative data by using first, second and third color data of each of the image blocks;

a mode determining part which determines the driving mode by using the image signal or a selection signal corresponding to the driving mode; and a duty determining part which determines a reference duty ratio of first, second and third colors in accordance with the driving mode, and determines duty ratios of the first, second and third color driving signals by using the first, second and third color representative data corresponding to the light-emitting blocks based on the reference duty ratio.

10. The light source apparatus of claim 8, wherein the reference duty ratio is a duty ratio of driving signals for the first, second and third color light sources to display white.

11. The light source apparatus of claim 8, wherein the peak current level is substantially equal to a maximum peak current level of a plurality of peak current levels that is employed to various driving modes of the light source module.

12. The light source apparatus of claim 11, wherein the reference duty ratio has a linear characteristic with respect to the various driving modes of the light source module.

13. The light source apparatus of claim 12, wherein a reference duty ratio of first, second and third colors is nA:nB:nC in a normal mode (B>C>A, and 'n' is an actual number), a reference duty ratio of the first, second and third colors is mA:mB:mC in a scanning mode ('m' is an actual number), and a reference duty ratio of the first, second and third colors is kA:kB:kC in a boosting mode ('k' is an actual number, and k>m>n).

14. The light source apparatus of claim 8, wherein the driving mode of the light source module comprises at least one of a normal mode which individually drives the light-emitting blocks in accordance with a luminance of each of a plurality of image blocks of a display panel, a scanning mode which drives the light-emitting blocks in a direction of gate lines of the display panel, and a boosting mode which drives a predetermined light-emitting block of the light-emitting blocks in a maximum luminance.

15. A display apparatus comprising:

a display panel comprising gate lines and data lines that are crossed with each other to display an image;

a light source module comprising a plurality of light-emitting blocks, each of the light-emitting blocks comprising a first color light source, a second color light source and a third color light source, respectively;

a local dimming control part which independently drives each of the light-emitting blocks by blocks, the local dimming control part sets a reference duty signal for first, second and third color driving signals in accordance with a plurality of local dimming driving modes of the light source module, the local dimming driving mode being determined using representative image data corresponding to each of a plurality of image blocks, which correspond to the plurality of light-emitting blocks, respectively; and a light source driving part which generates the first color driving signal, the second color driving signal and the third color driving signal by using a reference duty ratio set in accordance with the driving mode and a driving current having a same peak current level in accordance with the driving mode, wherein the peak current levels of the local dimming driving modes are the same as each other, and the reference duty ratios of the local dimming driving modes are different from each other.

16. The display apparatus of claim 15, wherein the local dimming control part comprises:

a representative determining part which divides an image signal into a plurality of image blocks corresponding to the light-emitting blocks, the representative determining part determines a first color representative data, a second color representative data and a third color representative data by using first, second and third color data of each of the image blocks;

a mode determining part which determines the driving mode by using the image signal or a selection signal corresponding to the driving mode; and a duty determining part which determines a reference duty ratio of first, second and third colors in accordance with the driving mode, and determines duty ratios of the first, second and third color driving signals by using the first, second and third color representative data corresponding to the light-emitting block based on the reference duty ratio.

17. The display apparatus of claim 15, wherein the reference duty ratio is a duty ratio of driving signals for the first, second and third color light sources to display white.

18. The display apparatus of claim 15, wherein the peak current level is substantially equal to a maximum peak current level of a plurality of peak current levels that is employed to various driving modes of the light source module.

19. The display apparatus of claim 15, wherein the reference duty ratio has a linear characteristic with respect to the various driving modes of the light source module.

20. The display apparatus of claim 15, wherein the driving mode of the light source module comprises a normal mode which individually drives the light-emitting blocks in accordance with a luminance of each of a plurality of image blocks of the display panel, a scanning mode which drives the light-emitting blocks in a direction of the gate lines, and a boosting mode which drives a predetermined light-emitting block of the light-emitting blocks in a maximum luminance, wherein a reference duty ratio of first, second and third colors is nA:nB:nC in the normal mode (B>C>A, and 'n' is an actual number), a reference ratio of the first, second and third colors is mA:mB:mC in the scanning mode ('m' is an actual number), and a reference ratios of the first, second and third colors is kA:kB:kC in the boosting mode ('k' is an actual number, and k>m>n).

* * * * *